US011110473B2

(12) United States Patent
Chung

(10) Patent No.: US 11,110,473 B2
(45) Date of Patent: Sep. 7, 2021

(54) FOAM PUMP SPRAYER

(71) Applicant: King Tsang Chung, Hongkong (CN)

(72) Inventor: King Tsang Chung, Hongkong (CN)

( * ) Notice: Subject to any disclaimer, the term of this patent is extended or adjusted under 35 U.S.C. 154(b) by 71 days.

(21) Appl. No.: 16/688,041

(22) Filed: Nov. 19, 2019

(65) Prior Publication Data

US 2020/0108406 A1 Apr. 9, 2020

Related U.S. Application Data

(63) Continuation of application No. PCT/CN2018/086012, filed on May 8, 2018.

(30) Foreign Application Priority Data

May 19, 2017 (CN) ..... 201710359422.1

(51) Int. Cl.

| | |
|---|---|
| ***B05B 11/00*** | (2006.01) |
| ***B05B 7/00*** | (2006.01) |
| ***F04B 19/06*** | (2006.01) |
| ***F04B 49/22*** | (2006.01) |

(52) U.S. Cl.

CPC ..... *B05B 11/3002* (2013.01); *B05B 7/005* (2013.01); *F04B 19/06* (2013.01); *F04B 49/225* (2013.01)

(58) Field of Classification Search

CPC ..... F04B 49/225; F04B 19/06; B05B 7/0018; B05B 7/0025; B05B 7/0037; B05B 7/005; B05B 11/0374; B05B 11/30; B05B 11/3002; B05B 11/3087

USPC ..... 222/190, 321.1–321.9, 145.5–145.6

See application file for complete search history.

(56) References Cited

U.S. PATENT DOCUMENTS

| | | | | |
|---|---|---|---|---|
| 6,612,468 | B2 * | 9/2003 | Pritchett | B05B 7/0037 222/190 |
| 7,337,930 | B2 * | 3/2008 | Ophardt | B05B 11/3087 222/190 |
| 8,616,414 | B2 * | 12/2013 | Ciavarella | B05B 7/0037 222/190 |
| 9,004,319 | B2 * | 4/2015 | Kim | B05B 11/3087 222/190 |
| 9,795,256 | B2 * | 10/2017 | Chung | B05B 7/0062 |
| 2007/0295754 | A1 | 12/2007 | Tourigny | |

(Continued)

FOREIGN PATENT DOCUMENTS

| | | | |
|---|---|---|---|
| CN | 1756602 | A | 4/2006 |
| CN | 101163881 | A | 4/2008 |

(Continued)

*Primary Examiner* — Jeremy Carroll

(57) ABSTRACT

A piston is formed by an outer edge of the cap. The piston and an inner wall of the nozzle body form a dynamic seal for the air cylinder, so that a main body of the air pump is formed. The cap extends downwardly to form a hydraulic cylinder. The hollow compression rod connects a pump component of the hydraulic cylinder and the mixing chamber of the head, so that a main body of the liquid pump is formed. The hollow compression rod is provided with an upper disk. The upper end of the upper disk passes the air outlet of the nozzle body and is inserted into the connecting pipe of the head in snap fit, and the upper disk opens or closes the air outlet. A fastening position is designed to form a gap between the head and the nozzle body to realize a floating valve function at the head.

5 Claims, 6 Drawing Sheets

(56) References Cited

U.S. PATENT DOCUMENTS

| | | | | |
|---|---|---|---|---|
| 2008/0093386 | A1* | 4/2008 | Arminak | B05B 11/3094 222/190 |
| 2011/0272432 | A1* | 11/2011 | Baughman | B05B 11/3087 222/136 |
| 2012/0104048 | A1* | 5/2012 | Tseng | B05B 7/0037 222/190 |
| 2013/0221553 | A1* | 8/2013 | Chen | C08J 11/04 264/8 |

FOREIGN PATENT DOCUMENTS

| | | | |
|---|---|---|---|
| CN | 201292924 | Y | 8/2009 |
| CN | 102691646 | A | 9/2012 |
| CN | 102822069 | A | 12/2012 |
| CN | 105083730 | A | 11/2015 |
| CN | 105564802 | A | 5/2016 |
| CN | 106115062 | A | 11/2016 |
| CN | 107187724 | A | 9/2017 |
| JP | H10165501 | A | 6/1998 |
| JP | 2013240759 | A | 12/2013 |
| WO | 2013151320 | A1 | 10/2013 |

* cited by examiner

FOAM PUMP SPRAYER

CROSS-REFERENCE TO RELATED APPLICATIONS

This application is a continuation of International Application No. PCT/CN2018/086012 with a filling date of May 8, 2018, designating the United states, now pending, and further claims to the benefit of priority from Chinese Application No. 201710359422.1 with a filing date of May 19, 2017. The content of the aforementioned applications, including any intervening amendments thereto, are incorporated herein by reference.

TECHNICAL FIELD

This application relates to domestic pump heads, and more particularly to foam pumps and optimizations thereof.

BACKGROUND OF THE INVENTION

Existing foam pumps are installed in bottle caps and are usually connected with extending tubes and nozzles for use. The foam pumps are mainly used for hand washing and sterilizations, and most of them have a precise and complicated structure and high cost, thereby limiting wide application thereof.

Commercially available foam pumps mainly use two pistons in series to respectively pump liquids and air into the mixing chamber to generate foams. Since pistons are required to seal cylinder walls, the friction between the piston and the cylinder wall is increased, so metal springs should be used to rebound. An air cylinder is adopted to obtain a larger gas-liquid ratio, which makes a diameter of the cap larger. For example, an outer cover of a commercially available foam pump has a diameter of 45 mm, and an outer cover of a conventional bath bottle has a diameter of 35 mm, so a diameter of the outer cover of the commercially available foam pump is 10 mm larger than that of the outer cover of the conventional bath bottle. Obviously, the commercially available foam pump cannot be installed in the conventional bath bottle. The air piston of the foam pump has a diameter of 32 mm, which is smaller than the outer cover of the conventional bath bottle. Therefore, the conventional bath bottle can be used when the piston is installed on the bottle cap, and if the piston has a diameter of 36 mm, 26% air can be additionally obtained.

Chinese Patent No. 201610268510.6 has disclosed a nozzle for a piston pump, where the piston is installed in the nozzle, and the bottle cap is the piston of the foam pump, which greatly reduces components of the foam pump and increases the air discharge of the piston pump.

The above invention has a simple pipeline and requires no precision mold. However, it still uses two pistons as the conventional foam pumps and has a large resistance. A reset spring should be adopted, which is not conductive to be recycled. At the same time, air and liquid check valves are still required, which increases assembly costs.

In order to overcome above defects, the present invention provides a floating valve structure at the nozzle head to solve the problem of air inlet and outlet check valves. Moreover, when elastic films or elastic bags are used as a reset element, the piston and the metal spring can be eliminated. In addition, a check valve can be punched using a punch die on an outlet of the elastic film or elastic bag, thereby reducing the overall cost.

SUMMARY OF THE INVENTION

The present invention provides a nozzle for a foam pump, comprising a cap, a nozzle body, a head, a hollow compression rod and an elastic reset element. The cap, the nozzle body and the head are sequentially installed from bottom to up.

A hydraulic cylinder extends from a center of the cap, and a liquid inlet check valve is installed at a bottom of the hydraulic cylinder.

An outer edge of the cap forms a piston, and the cap is capable of entering the nozzle body; the piston and an inner wall of the nozzle body form a dynamic seal; the nozzle body slides on an outer wall of the cap, so that a main body of an air pump is formed.

A first fastening position is formed by an outer surface of an upper end of the cap and an inner surface of a lower end of the dispenser to prevent the disengagement of the cap and the nozzle body and reduce the lateral movement.

An air outlet is provided at a center of the nozzle body, and a hollow compression rod penetrates through the air outlet; the hollow compression rod is provided with an upper disk which is configured to open or close the air outlet; a connecting pipe of the head is inserted into an upper end of the hollow compression rod, and the connecting pipe is provided with a second fastening position; a mixing chamber is provided in the connecting pipe of the head. In the hydraulic cylinder, the lower end of the hollow compression rod is provided with the pump component, such as an elastic ring (O-ring), an elastic film or an elastic bag, so that a main body of the liquid pump is formed.

The nozzle body is further provided with an air inlet.

A gap is formed between the head and the nozzle body through a second fastening position so as to form a floating valve. When the head is pressed, the gap disappears; a bottom of the head moves downwardly to a surface of the nozzle body to form a seal, and the air inlet of the nozzle body is closed; at the same time, the hollow compression rod drives the upper disk to move downwardly, so that the air outlet between the nozzle body and the head is opened. When the head is released, the elastic reset element rebounds, and the head moves upwardly; the hollow compression rod moves upwardly, and the upper disk closes the air outlet. At the same time, the bottom of the head rises, and the gap recovers to open the air inlet, so that air inlet and outlet check valves are formed. That is, the floating valve is configured to open and close the air inlet and outlet passages in a small stroke, which is completely consistent with the pumping and suction requirements in the timing of linkage.

When the head is continuously pressed, the liquids and the air are introduced into the mixing chamber to generate foams, and then the foams flow out from the head opening. When the head is released, the elastic reset element rebounds, and the small stroke of the floating valve is firstly actuated, and the head moves upwardly to open the air inlet. The piston moves downward relative to the nozzle body to pump the air to realize the suction function of the air pump. At the same time, the pump component of the liquid pump allows the liquid pump to pump the liquids, thereby realizing the liquid suction function of the liquid pump.

The elastic reset element is installed between the cap and the upper disk of the hollow compression rod.

In some embodiments, the elastic reset element is a conical metal spring; the pump component of the liquid pump is an elastic ring; and the liquid outlet check valve is installed in the mixing chamber.

In some embodiments, the elastic reset element and the pump component of the liquid pump is the elastic film which is installed in the hydraulic cylinder of the cap in a sealed manner.

In some embodiments, the elastic reset element and the pump component of the liquid pump is the elastic bag which is installed in the hydraulic cylinder of the cap in a sealed manner.

Further, the liquid outlet check valve is a cross-shaped check valve which is punched using a punch die at a center of a cambered surface of the elastic film or elastic bag and is installed at a lower end of the hollow compression rod in a sealed manner.

The present invention has the following beneficial effects.

1. The floating valve structure is formed by the head and the nozzle body, so that the check valve for the inlet and outlet of the air and liquids is realized.

2. The elastic film or elastic bag are used as the elastic reset element of the foam pump, and the metal spring can be eliminated.

3. The fastening position of the dispenser is divided into a plurality of fastening portions which can adaptedly slide along corresponding chutes on the cap, thereby greatly reducing the lateral movement of the nozzle body.

The foam pump of the present invention has a simple structure and low cost.

When the elastic bag replaces the elastic film as the reset element, it can also be configured to be a liquid inlet check valve.

DETAILED DESCRIPTION OF EMBODIMENTS

Example 1

Figure 1:
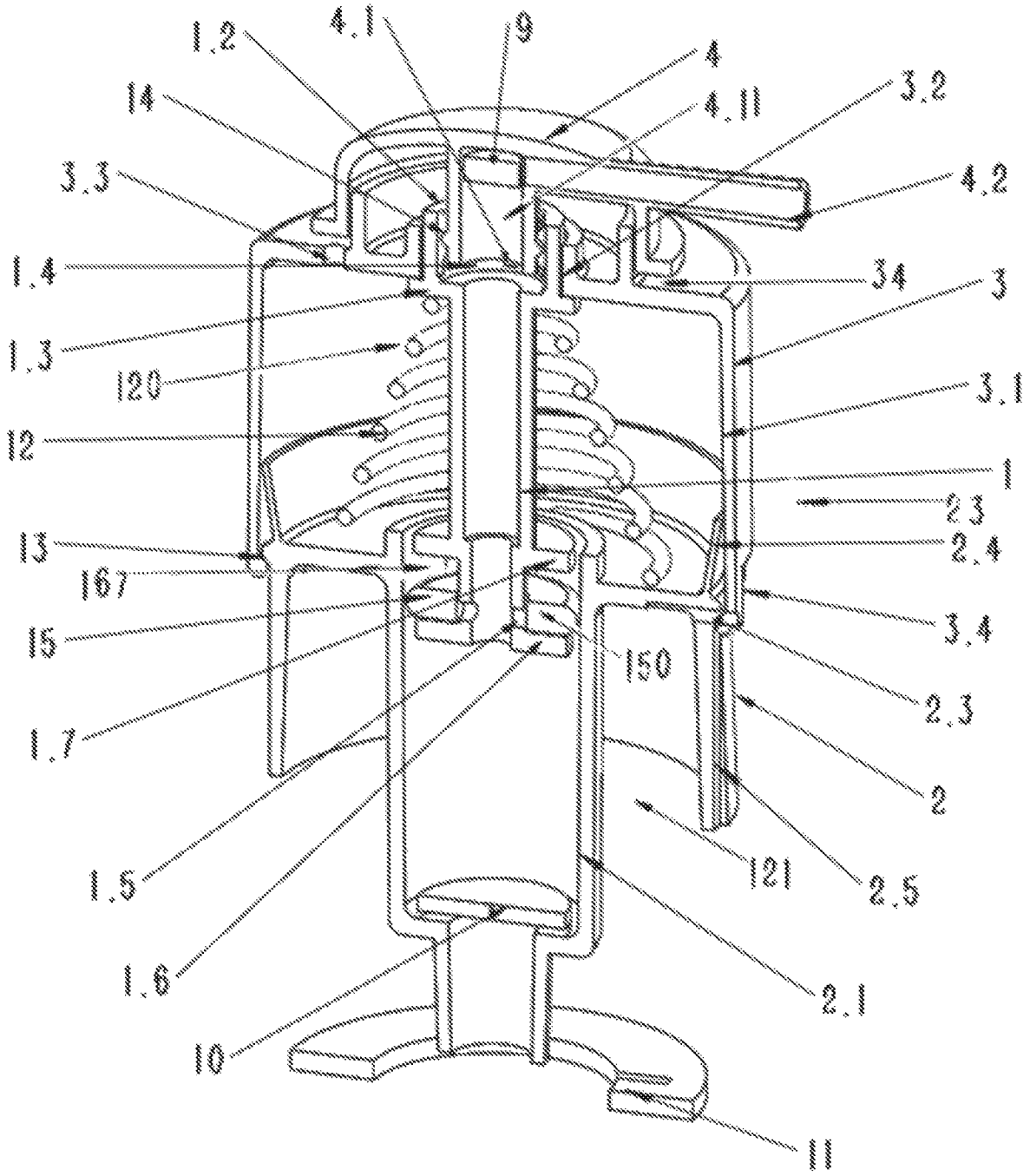
FIG. 1 is a cross-sectional view of a nozzle for a foam pump according to a first embodiment of the present invention.

As shown in FIG. 1, illustrated is a foam pump, comprising a cap (2), a nozzle body (3), a piston (2.4) and a hollow compression rod (1). A hydraulic cylinder (2.1) extends downwardly from the cap (2), and the hydraulic cylinder and the cap are integrally formed. The piston (2.4) is arranged at an outer edge of the cap (2), and an air cylinder (3.1) is formed by an inner wall of the nozzle body (3). A dynamic seal for the air cylinder (3.1) is realized by the piston (2.4).

A first fastening position (13) is provided by an upper edge of the cap (2) and a lower edge of the nozzle body (3). The lower edge of the nozzle body (3) is divided into a plurality of fastening portions (3.4) to increase flexibility of the first fastening position, facilitating the demolding of mold cores during manufacturing of plastics as well as the entering of the fastening position of the cap during assembling. At the same time, the fastening portions (3.4) of the nozzle body adaptedly slide along corresponding chutes (2.5) on a side wall of the cap to reduce lateral movements of the nozzle body.

An air outlet (3.2) is provided at a center of the nozzle body (3), and an air inlet (3.3) is provided on the nozzle body (3).

The hollow compression rod (1) is an independent component. Two lower disks (1.6; 1.7) are provided at a lower end of the hollow compression rod (1), and the hollow compression rod (1) between the two disks (1.6; 1.7) has a lateral hole (1.5) and is provided with an elastic ring (15). When the hollow compression rod (1) slides up and down, the elastic ring (15) acts as a check valve for liquid outlet of the lateral hole (1.5). An outer edge of the elastic ring (15) forms a dynamic seal for the hydraulic cylinder (2.1) of the cap (2).

The hollow compression rod (1) is provided with an upper disk (1.3), and a conical spring (12) is installed between the cap (2) and the upper disk (1.3). When the cap (2) and a head (4) are engaged to form the first fastening position (13), an initial pressure is formed by the conical spring (12), so that the upper disk (1.3) blocks the air outlet (3.2) of nozzle body (3).

An upper end (1.2) of the upper disk (1.3) passes through the air outlet (3.2) of the nozzle body (3), and a connecting pipe (4.1) of the head (4) is inserted into the upper end of the upper disk (1.3). A second fastening position (14) is provided at the connecting tube (4.1) to allow a gap between the bottom of the head (4) and a surface of the nozzle body (3) to be 2 mm. With the second fastening position, the nozzle body and the head are uneasy to disengage with each other.

No seal is provided between the head (4) and the nozzle body (3), and a float valve structure is formed. When the head (4) is pressed, the gap (34) between the bottom of the head and a surface of the nozzle body (3) disappears, and the bottom of the nozzle (4) is moved down to the surface of the head to form a seal, and the air inlet (3.3) of the nozzle body (3) is closed. At the same time, the downward movement of the hollow compression rod (1) allows the upper disk (1.3) to open the air outlet (3.2) of the nozzle body (3), and the elastic ring (15) moves upwards relative to the hollow compression rod, so that the lateral hole (1.5) of the hollow compression rod (1) is opened to introduce liquids into a mixing chamber (4.11). Air is introduced into the mixing chamber (4.11) by the piston through the air outlet (3.2) and a semicircle groove (1.4) between the upper end (1.2) of the hollow compression rod and the connecting pipe (4.1) of the head. Then, foams are generated by the air and the liquids, and then are led out from a nozzle port (4.2).

When the head (4) is released, a metal spring (12) rebounds, and the hollow compression rod (1) rises, so that the gap (34) recovers, and the air inlet (3.3) of the nozzle body (3) is opened. The upper disk (1.3) of the hollow compression rod (1) moves up to close the air outlet (3.2), and the elastic ring (15) moves downwardly relative to the hollow compression rod, so that the lateral hole (1.5) of the hollow compression rod (1) is closed. The hollow compression rod drives the elastic ring (15) to move upwardly, so that a negative pressure is formed in the hydraulic cylinder for the pumping of liquids. At the same time, due to the piston (2.4), external gases are pumped into the air cylinder (3.1) from the air inlet (3.3).

It can be seen that under the combined action of the metal spring (12) and the hollow compression rod (1), the float valve gap between the head (4) and the nozzle body (3) acts as a check valve for opening and closing the air inlet, air outlet and the liquid outlet. The float valve of the head (4) involves small stroke and resistance, so the air inlet and outlet passages can be quickly opened or closed, and the lateral hole (1.5) of the hollow compression rod (1) is quickly opened.

The metal spring (12) shown in the drawings is conical, and a diameter of each turn of the spring is one wire diameter larger than that of a previous turn thereof, so that the spring can be pressed into a flat shape, and a height of the pressed spring equals to the wire diameter. A lower end of the metal spring (12) is located on the upper surface of the cap (2), and an upper end of the metal spring (12) abuts against the upper disk (1.3) of the hollow compression rod (1). Therefore, in any case, the hollow compression rod (1) moves with the metal spring (12) to ensure the effectiveness of the opening and closing for the air outlet.

An inner space of the connecting pipe (4.1) of the head is the mixing chamber (4.11), and an end port (1.2) of the hollow compression rod is provided with the semicircle groove (1.4) from which the air enters the mixing chamber (4.11). The air enters the bottom of the mixing chamber (4.11) from the upper portion of the end port, and the air has been divided into small air streams which can be directly bubbled into the liquid. Then, the air bubble will be divided by a foaming net (9), which increases the dividing ways so as to obtain finer foams.

When the foam pump is not in use, a small amount of liquids and foams which are not led out partially remain in the bottom of the mixing chamber (4.11). Since a distance is set between the end port and the bottom of the mixing chamber (4.11), the liquids will not overflow the end port. The semicircular groove has a small diameter, and the arrangement of the semicircular groove will not cause too much resistance to the air entering the mixing chamber (4.11). Moreover, due to the capillary phenomenon (surface tension) of the liquids, even though the bottle is dumped, the liquids, especially viscous liquids, in the mixing chamber will not easily flow out from the semicircular groove.

In some embodiments, a liquid outlet check valve (12) of the foam pump is arranged in the mixing chamber (4.11) and above the liquid outlet; preferably, the liquid outlet check valve is a changeover check valve.

A foaming net (9) is provided in the mixing chamber (4.11); and a liquid inlet check valve (10) is provided at a bottom of the hydraulic cylinder.

In order to balance the pressure in the inner space of the bottle, the cap is provided with a balance hole (2.3) opposite to a moveable sheet (11) of a seal ring of the bottle opening.

The elastic ring (15) has similar functions with conventional pistons, and the elastic ring must form a dynamic seal for the hydraulic cylinder, so the problem of friction resistance should be solved. If the elastic ring is changed into an elastic film or an elastic bag, there is no requirement for the dynamic sealing for the cylinder wall, and no friction will be caused to the hydraulic cylinder. The beneficial effect of the elastic film or bag is that the metal spring with a smaller wire diameter is used as an elastic reset element (120).

Actually, the elastic film or bag can be directly used as the elastic reset element (120), and the metal spring can be eliminated by increasing the thickness and elasticity of the elastic film or the elastic bag, which is illustrated in the following examples.

Example 2

Figure 2:
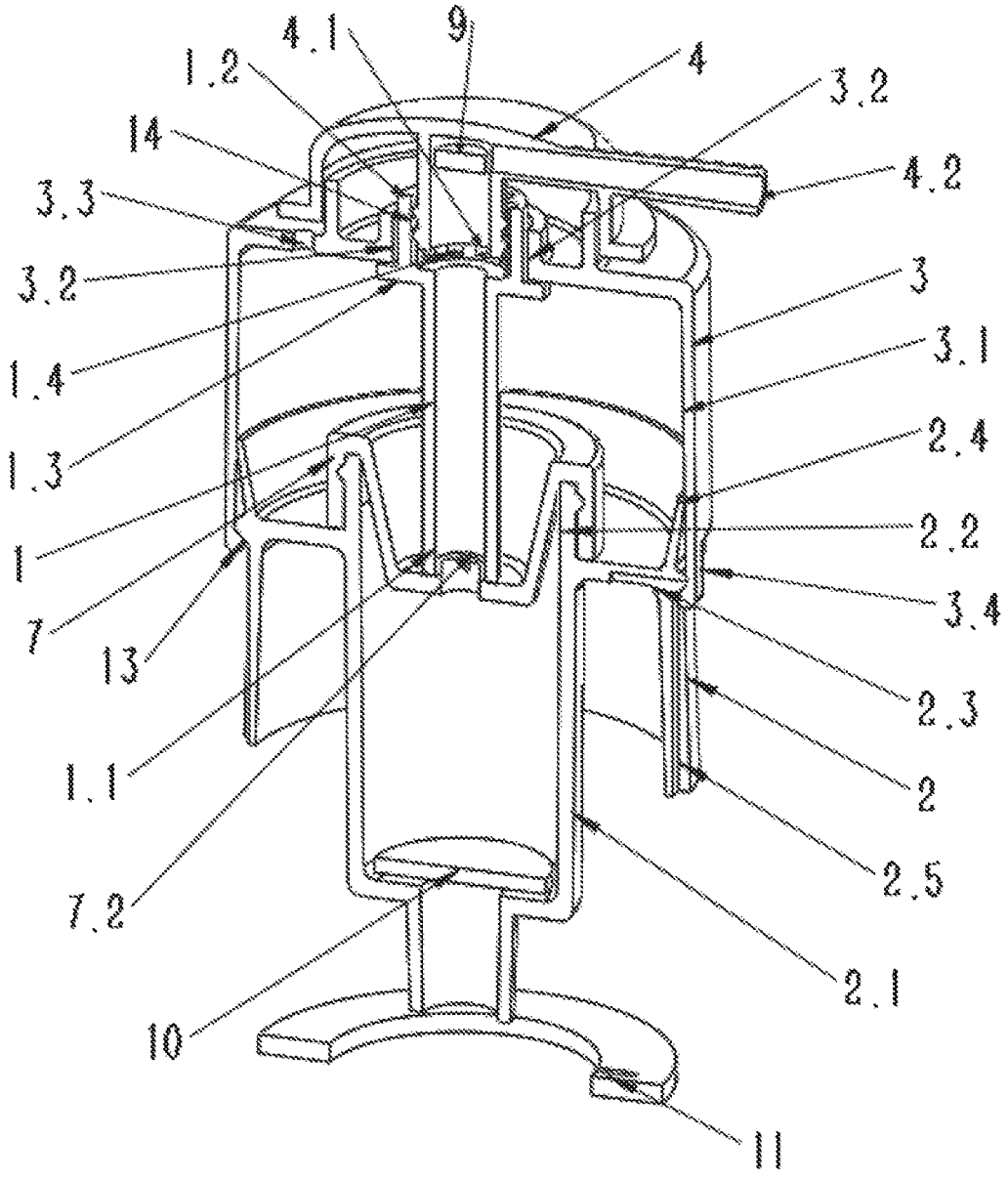
FIG. 2 is a cross-sectional view of the nozzle according to a second embodiment of the present invention.

As shown in FIG. 2, the hydraulic cylinder (2.1) extends downwardly from the cap (2), and the hydraulic cylinder and the cap are integrally formed, which are molded by injection molding in one time. The cap (2) is provided with a circular wall (2.2), and a thick sealing surface of the elastic film (7) is installed on an inner side of the circular wall (2.2), so that the circular wall (2.2) is used to overcome the horizontal component of the elastic film when the elastic film is extended, and when the elastic film (7) is extended, the vertical component of the elastic film is used to increase the sealing pressure.

Figure 8:
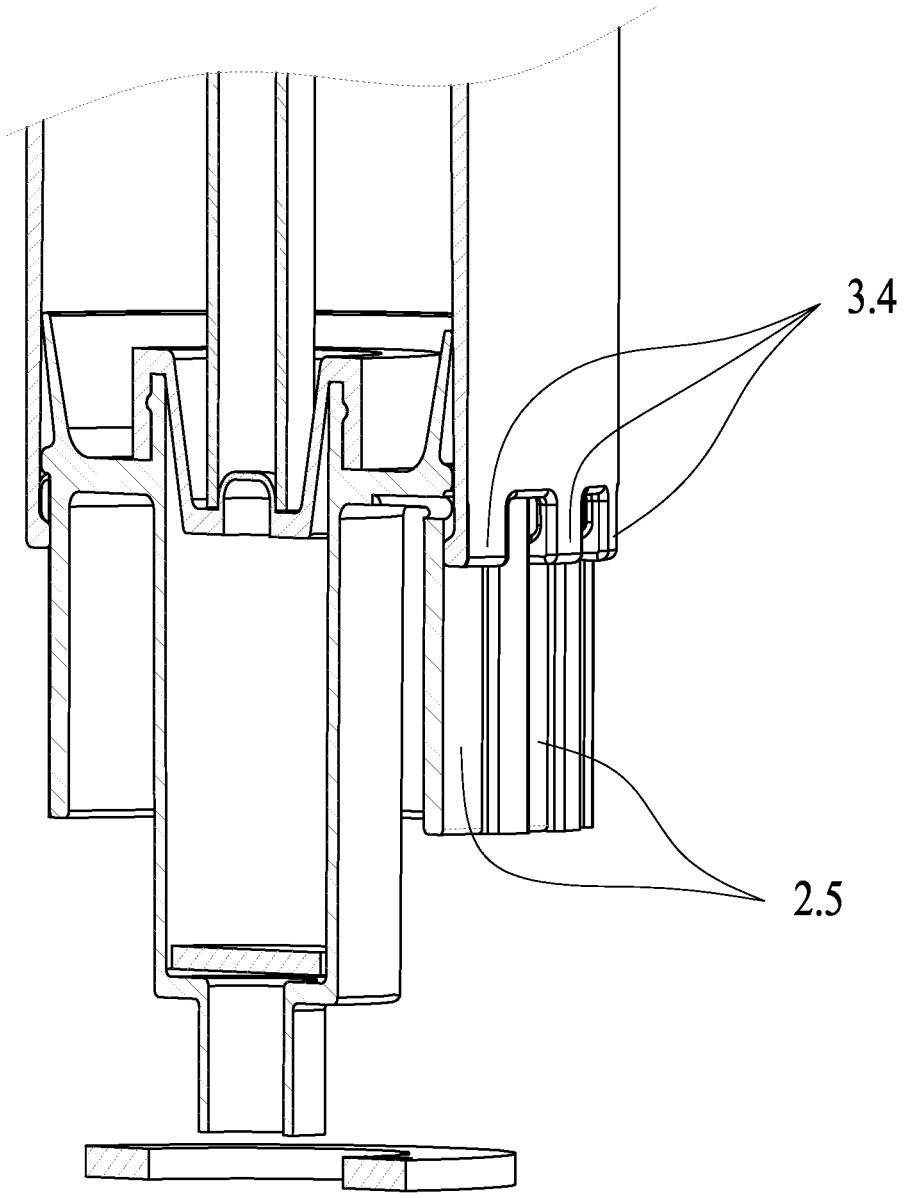
FIG. 8 shows a plurality of chutes along which a plurality of fastening portions are slidable according to the second embodiment of the present invention.

The piston (2.4) is provided at an outer edge of the cap (2), and the air cylinder (3.1) is formed by the inner wall of the nozzle body (3). The piston forms a dynamic sealing for the air cylinder (3.1). An upper edge of the cap (2) and a lower edge of the nozzle body (3) form a first fastening position (13), and the lower edge of the dispenser (3) is divided into a plurality of fastening portions (3.4) which are capable of adaptedly sliding along corresponding chutes (2.5) on a side wall of the cap (2) as shown in FIG. 8.

A lower end (1.1) of the hollow compression rod (1) is adaptedly inserted into an outlet (7.2) of the elastic film (7).

The nozzle body (3) has an air outlet (3.2) in the center, and the hollow compression rod (1) is provided with an upper disk (1.3). The hollow compression rod (1) passes through the air outlet (3.2). A gap between the air outlet (3.2) and the hollow compression rod (1) is an outlet passage of the air. The upper end (1.2) of the hollow compression rod is inserted in the connecting tube (4.1) of the head which is provided with a second fastening position (14) to allow a gap (34) between the bottom of the head (4) and the surface of the nozzle body (3) to be about 2 mm, so that the head and the nozzle body are uneasy to disengage with each other. Due to the limitation of the first fastening position (13), when the hollow compression rod (1) applies an initial pressure to the elastic film (7), the upper disk (1.3) close the air outlet (3.2).

No seal is provided between the head (4) and the nozzle body (3), so that a float valve structure is formed. When the head (4) is pressed, the gap (34) between the bottom of the head and a surface of the nozzle body (3) disappears, and the bottom of the head (4) is moved down to the surface of the head to form a seal, and the air inlet (3.3) of the nozzle body (3) is closed. At the same time, the upper disk (1.3) of the hollow compression rod (1) moves downwardly to open the air outlet (3.2) of the nozzle body (3). The head is continuously pressed, so that air is introduced into the mixing chamber (4.11) by the piston through the air outlet (3.2) and a semicircle groove (1.4) between the upper end (1.2) of the hollow compression rod and the connecting tube (4.1) of the head. At the same time, the lower end (1.1) of the hollow compression rod (1) presses the elastic film (7) to force the liquids to be introduced to the mixing chamber (4.11), through the check valve of the outlet (7.2) of the elastic film. Then, foams are generated and led out from a nozzle port (4.2).

When the head (4) is not pressed, the elastic film rebounds, and a negative pressure is formed in a cylinder formed by the elastic film (7) for the pumping of the liquids. At the same time, the elastic film (7) allows the upper disk (1.3) of the hollow compression rod (1) to move upwardly to close the air outlet (3.2). The gap (34) between the dispenser (3) and the head (4) recovers, so that the air inlet (3.3) of the nozzle body (3) is opened. Due to the piston (2.4), the air is pumped into the air cylinder (3.1).

It can be seen that under the combined action of the elastic film (7) and the hollow compression rod (1), the float valve gap (34) between the head (4) and the nozzle body (3) acts as a check valve for opening and closing the air inlet.

A foaming net (9) is provided in the mixing chamber (4.11). In some embodiments, a changeover check valve (12) is arranged above the liquid outlet of the mixing chamber (4.11). A liquid inlet check valve (10) is provided at a bottom of the hydraulic cylinder (2.1) of the cap.

Figure 3:
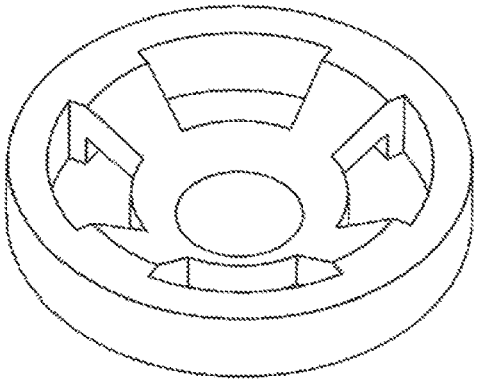
FIG. 3 is a partial view of a check valve according to the second embodiment of the present invention.
Figure 4:
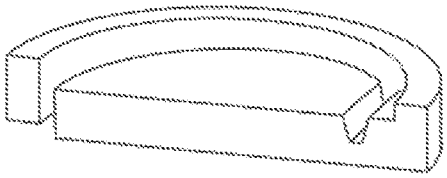
FIG. 4 is a partial view of a check valve according to the second embodiment of the present invention.

As shown in FIGS. 3-4, the middle sealing surface is at an angle with the annular mounting surface, and a check valve which has an initial pressure on the sealing surface is easy to be obtained. Such check valve is installed at the bottom of the hydraulic cylinder or in the mixing chamber (4.11). The initial pressure prevents the liquids from flowing out of the bottle when the bottle is inclined.

Figure 5:
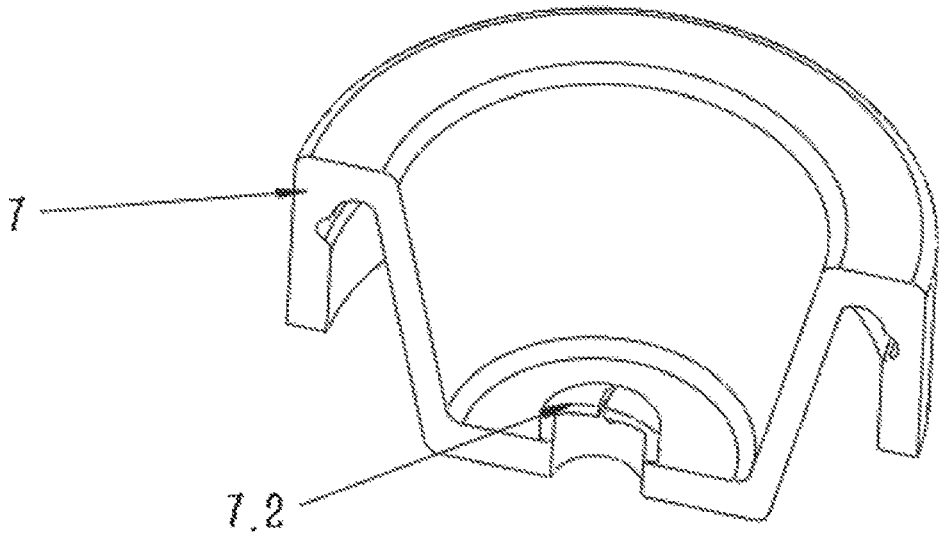
FIG. 5 is a partial view of an elastic film according to the second embodiment of the present invention.

As shown in FIG. 5, a cross-shaped opening is punched using a punch die on a cambered surface of the upper end (7.2) of the elastic film, thereby forming the liquid outlet check valve with four moveable sheets of 90 degrees. Each of the four moveable sheets use cutting surfaces of other moveable sheets as a sealing surface. The drawings are just for illustration, and actually, the cross cut is a punching without margin, so the gap (34) does not exist.

For example, a cross cut of 3 mm is provided on nipples of feeding bottles so as to prevent milk from flowing out when the feeding bottles are inverted.

In order to balance the pressure in the inner space of the bottle, the cap is provided with a balance hole (2.3) which is opposite to the moveable sheet (11) of the seal ring.

The elastic film may be made of elastomers such as TPE, TPU, TPR, etc. An elongation of these elastomers is more than 200-300% and an elongation at break of these elastomers is more than 600%. Since the involved stroke is generally 15-20 mm, the requirements for the elongation is met when the distance between the pressed surface and the sealing surface of the elastic film is 7-8 mm. The elastic film (1) with such length can be set in the hydraulic cylinder of the cap, because the hydraulic cylinder of conventional foam pumps has a length of about 40 mm to provide a stroke for the piston and accommodate the metal spring. When extending, the elastic film does not contact with a wall of the hydraulic cylinder, so no friction resistance will be formed. When the elastic film is extended, the strain increases, and the stress increases proportionally, thus providing sufficient resilience for the pumping of liquids and air. Obviously, the resilience is related to the thickness of the elastic film and the properties of the elastic material, which provides more selection and design possibilities.

The elastic reset element (120) can also be an elastic bag, which is illustrated in the following example.

Example 3

Figure 6:
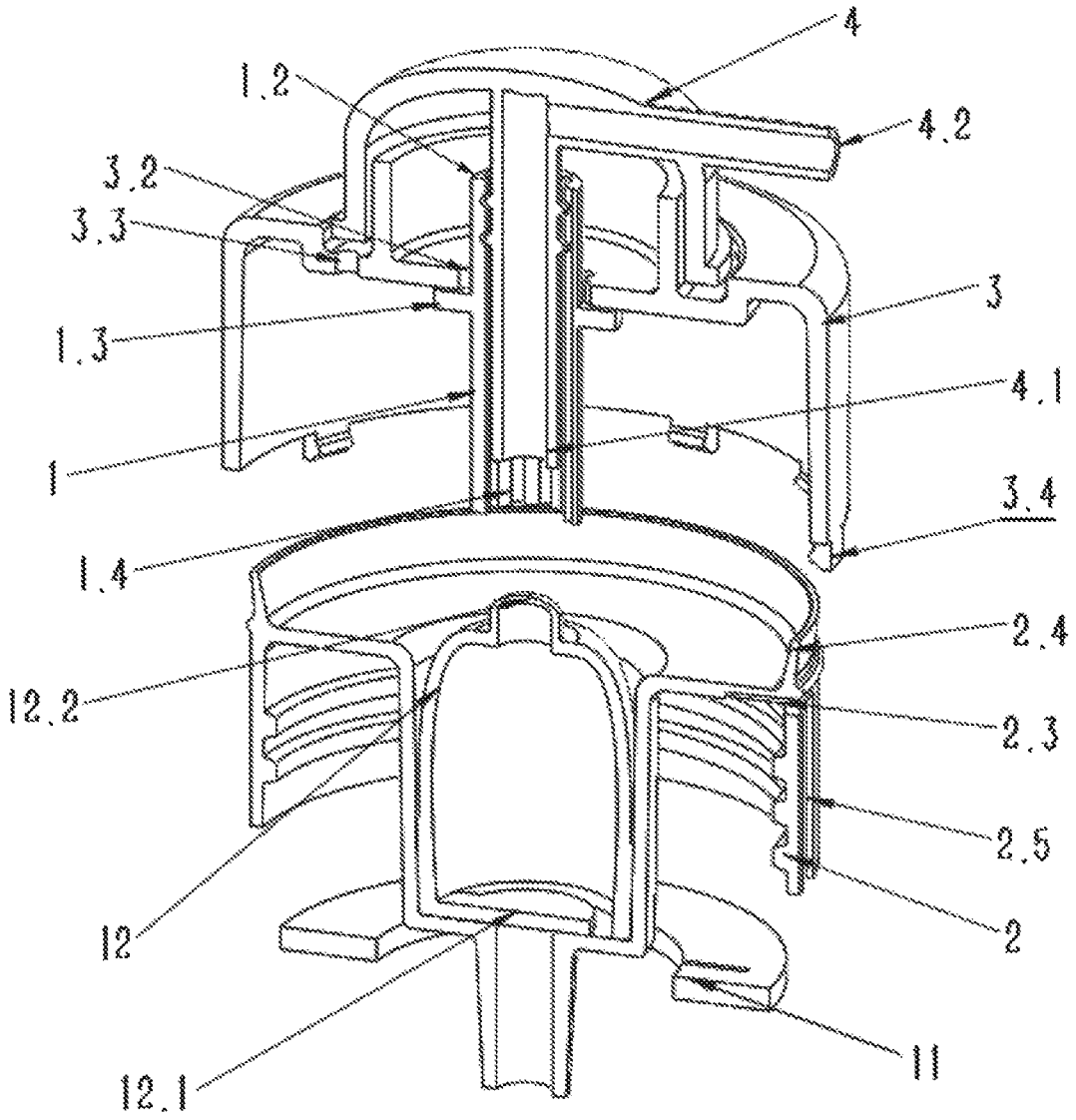
FIG. 6 is a cross-sectional view of the nozzle for the foam pump according to a third embodiment of the present invention.

As shown in FIG. 6, the elastic film of the foam pump is replaced with an elastic bag (12).

As a component of the hydraulic cylinder, the elastic bag (12) is arranged in the hydraulic cylinder (2.1) of the cap (2). Under the force of the hollow compression rod (1), the sealing effect for the bottom of the hydraulic cylinder is strengthened. The cap (2) is provided with the piston (2.4).

Figure 7:
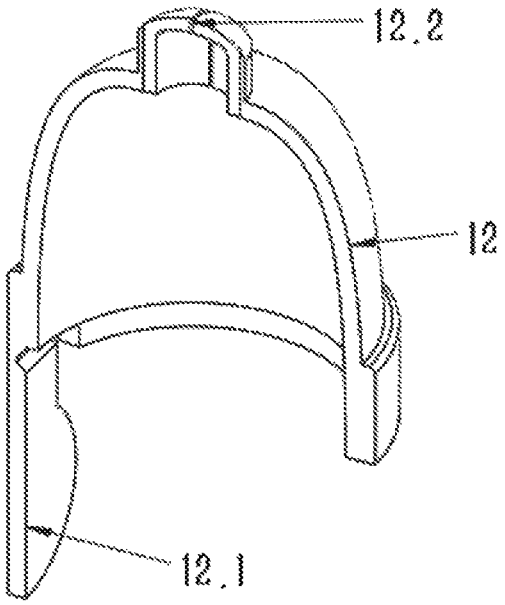
FIG. 7 is a cross-sectional view of an elastic bag of the present invention, in which a fastening structure is provided at the elastic bag.

As shown in FIG. 7, an inlet check valve (12.1) can be designed at a lower opening of the elastic bag (12). In order to meet the demolding requirements of the mold core, the check valve (12.1) should be parallel to a center line of the elastic bag. During assembling, the check valve is pressed into a recess at the bottom of the elastic bag through the bending position to form a firm connection. A depth of the recess equals to a thickness of the check valve, so a flat sealing surface is easy to be obtained. The angle between the recess surface and the sealing surface can be changed, so the initial sealing pressure of the check valve (12.1) can be easily applied to the inlet of the hydraulic cylinder.

As shown in FIG. 6, an elongated connecting pipe is provided to form a slender mixing chamber (4.11), so that foams are divided in the turbulent flow, and the foaming net may be eliminated.

The arrangement relationship of the hollow compression rod (1) and the head (4), etc., still retains the floating valve structure in Examples 1 and 2.

The upper end (12.2) of the elastic bag (12) has a liquid outlet check valve punched by a punch die, or a changeover check valve is arranged in the mixing chamber (4.11) and above the liquid outlet.

In order to balance the pressure in the inner space of the bottle, the cap is provided with a balance hole (3) which corresponds to the moveable sheet of the seal ring (11) of the bottle opening.

It should be noted that the elastic film or the elastic bag functions as a liquid pump (121), and the discharge volume thereof is not related to the diameter of the hydraulic cylinder. The friction between the elastomer and the cylinder wall can be reduced or avoided using a cylinder having a large diameter. Moreover, with such cylinder, the liquid inlet check valve is easy to be installed, and the suction resistance for the liquids is reduced.

In the above embodiments, components of the foam pump should be connected by fastening positions to prevent the detachment thereof, and the lateral movement of the nozzle can be reduced. The linear contact between the piston and the air cylinder can be changed into a surface contact.

Different fastening forms are provided in the embodiments of the present invention. Various fastening forms are adopted for assembling plastic toys, which are general technical solutions, so the fastening forms will not be discussed in detail herein.

Further, the foam pump uses the outer wall of the cap to carry out the stroke of the dispenser, which greatly reduces the height of the foam pump. However, the foam pump still has a shape similar to that of conventional foam pumps, which adapts to customers' aesthetic standards and using habits. The fusion of functions of the pump components reduces the number of pump components and the height of the pump, which provides conditions for increasing the piston stroke.

The pump is made of high polymers, and no spring is used, which is convenient for recycling. For example, high polymers TPE and PP are compatible and can even be mixed with PP bottles for recycling to obtain a certain PP modified polymer.

The upper disk of the hollow compression rod can be designed into a fastener, and the switch is formed with a moveable sealing surface in snap fit, but it requires a precision mold for production, which increases the cost for the mold.

Those skilled in the art can make reasonable choices on issues such as check valves, fastener positions and installation techniques for the pump of foam pumps. Adjustments to the configurations of the components of the present invention can also be made, and all adjustments shall fall within the scope of the present invention. Therefore, the above embodiments are not intended to limit the scope of the present invention.

I claim:

1. A nozzle for a foam pump, comprising a cap;

a nozzle body;

a head;

a hollow compression rod; and an elastic reset element;

wherein the cap is capable of entering the nozzle body; an outer edge of the cap and an inner wall of the nozzle body form a dynamic seal; the nozzle body slides on an outer wall of the cap, forming a main body of an air pump;

a first fastening position is provided at an upper edge of the cap and a lower edge of the nozzle body;

a hydraulic cylinder is provided at the cap and is provided with a pump component; a liquid inlet check valve is installed at a bottom of the hydraulic cylinder;

an air outlet is provided at a center of the nozzle body, and a hollow compression rod penetrates through the air outlet; the hollow compression rod is provided with an upper disk which is configured to open or close the air outlet; a connecting pipe of the head is fixedly inserted into an upper end of the hollow compression rod through a second fastening position; a mixing chamber is provided in the connecting pipe of the head;

the nozzle body is further provided with an air inlet;

a gap is formed between the head and the nozzle body through the second fastening position so as to form a floating valve; when the head is pressed, the gap disappears; a bottom of the head moves downwardly to a surface of the nozzle body to form a seal, and the air inlet of the nozzle body is closed; at the same time, the upper disk of the hollow compression rod opens the air outlet; when the head is released, the elastic reset element rebounds, and the head moves upwardly, and the gap recovers to open the air inlet, so that an air inlet check valve is formed; and the upper disk of the hollow compression rod closes the air outlet, so that an air outlet check valve is formed; and the pump component of the hydraulic cylinder is installed on a lower end of the hollow compression rod, forming a main body of the liquid pump.

2. The nozzle of claim 1, wherein the elastic reset component is a metal spring which is installed between the cap and the upper disk of the hollow compression rod;

the pump component is an elastic ring which forms a dynamic seal for the hydraulic cylinder and is installed between two lower disks which located at a lower end of the hollow compression rod; a lateral hole is provided on the hollow compression rod; when the head is pressed, the elastic ring acts as a liquid outlet check valve for the lateral hole; and the liquid inlet check valve is a changeover check valve.

3. The nozzle of claim 1, wherein the pump component of the hydraulic cylinder is an elastic film which is sealingly installed in the hydraulic cylinder in a sealed manner and serves as the elastic reset element;

the liquid outlet check valve is a check valve punched using a punch die on a center of a cambered surface of the elastic film; the liquid outlet check valve is installed at an opening of the lower end of the hollow compression rod in a sealed manner; and the liquid inlet check valve is a changeover check valve.

4. The nozzle of claim 1, wherein an elastic bag is installed in the hydraulic cylinder of the cap; and the elastic bag is the elastic reset element;

the liquid outlet check valve is a check valve punched using a punch die on a center of a cambered surface of the elastic bag; the liquid outlet check valve is installed at an opening of the lower end of the hollow compression rod in a sealed manner; and the liquid inlet check valve is a changeover check valve which is provided by the elastic bag.

5. The nozzle of claim 1, wherein the first fastening position of the nozzle body comprises a plurality of fastening portions; a plurality of chutes are correspondingly provided on the cap, and the fastening portions are capable of adapatedly sliding in the chutes.

* * * * *